United States Patent [19]

Volkmann

[11] Patent Number: 4,871,009

[45] Date of Patent: Oct. 3, 1989

[54] ANTI-SHIFT ASSEMBLY FOR MOLD MATCHBOARDS

[76] Inventor: Adolf P. E. Volkmann, 425 N.E. 80th Ave., Portland, Oreg. 97213

[21] Appl. No.: 331,234

[22] Filed: Mar. 31, 1989

[51] Int. Cl.[4] ..... B22C 7/00; B22C 9/02

[52] U.S. Cl. ..... 164/243; 164/241; 164/339

[58] Field of Search ..... 164/241, 243, 239, 339, 164/341, 364, 29

[56] References Cited

U.S. PATENT DOCUMENTS

| | | | |
|---|---|---|---|
| 1,561,500 | 11/1925 | Wood . | |
| 1,717,109 | 6/1929 | Last . | |
| 3,241,199 | 3/1966 | Rabinovich . | |
| 3,897,817 | 8/1975 | Nieman | 164/364 |
| 4,632,171 | 12/1986 | Almond | 164/255 |
| 4,662,426 | 5/1987 | Scherer | 164/412 |

FOREIGN PATENT DOCUMENTS

| | | |
|---|---|---|
| 1173618 | 7/1964 | Fed. Rep. of Germany . |
| 1183486 | 1/1959 | France . |

*Primary Examiner*—Richard K. Seidel
*Assistant Examiner*—J. Reed Batten, Jr.
*Attorney, Agent, or Firm*—Eugene M. Eckelman

[57] ABSTRACT

A first insert is arranged to be engaged with one surface of a matchboard in alignment with a bore in the matchboard. A second insert has a portion thereof arranged to be engaged with the opposite surface of the matchboard at the bore. The first and second inserts have impression forming portions arranged to make recess and projecting contours respectively in impression material with a close tolerance interfitting engagement when in facing relation to provide anti-shifting connection to opposed portions of the impression material. The inserts have a telescoping engagement which precisely aligns the first and second inserts in their impression forming functions, and such telescoping arrangement provides adjustable mounting of the inserts on matchboards of different thicknesses.

8 Claims, 1 Drawing Sheet

ANTI-SHIFT ASSEMBLY FOR MOLD MATCHBOARDS

BACKGROUND OF THE INVENTION

This invention relates to new and useful improvements in anti-shift assemblies for mold matchboards. The present invention is primarily used in conjunction with foundry castings but it is to be understood that it can be practiced with any work that utilizes matching faces of impression material or any two sides that have to match perfectly.

In applicant's prior U.S. Pat. No. 4,794,975, anti-shift insert means was disclosed that importantly eliminated disposable type cores. One of applicant's embodiments in that patent used opposite inserts having stem portions mounted in a common bore in matchboards for precisely aligning the two inserts. One insert is seated on one surface of the matchboard and the other insert is contained in a recess having axial alignment with the bore.

SUMMARY OF THE INVENTION

According to the present invention and forming a primary objective thereof, an anti-shift assembly is provided for mold matchboards which has improvements in its structure and use, in particular such an assembly that creates a perfect match of mold parts and also can accurately adjust to matchboards of different thicknesses.

Another object is to provide an anti-shift structure having means forming collecting areas for loose impression material whereby to insure close fitting of matching components.

In carrying out the above objectives, a first insert is arranged to be engaged with one surface of a matchboard in alignment with a bore in the matchboard. A second insert is arranged to be engaged with the opposite surface of the matchboard also in alignment with the bore. These inserts have impression forming portions arranged to make recessed and projecting contours in impression material with a close tolerance interfitting engagement when in facing relation to provide anti-shifting connection to opposed portions of the impression material. The first insert projects outwardly from the surface of the matchboard and the second insert projects into the bore. The inserts have telescopically engaging portions precisely aligning them in their impression forming functions. The inserts have means arranged to receive a fastener for holding them together in adjusted clamped position on opposite surfaces of a matchboard. Also these inserts have bore engaging portions for properly positioning the inserts in the bore.

The invention will be better understood and additional objects and advantages will become apparent from the following description taken in connection with the accompanying drawings.

DETAILED DESCRIPTION OF A PREFERRED EMBODIMENT

Figure 1:
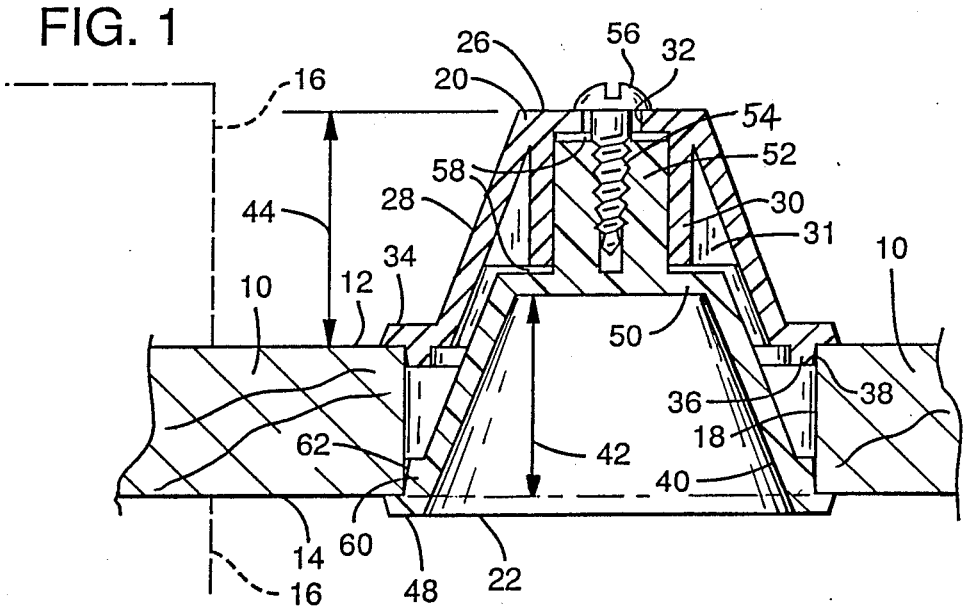
FIG. 1 is a sectional view through a matchboard with the present anti-shift inserts installed therein.

With reference to FIG. 1, the numeral 10 designates a matchboard which, except for aligning functions, is utilized in a conventional manner to form castings in an air set or other system. This matchboard 10 has opposite surfaces 12 and 14 for supporting pattern parts 16 to be combined for forming a mold, namely, forming the two parts of the pattern for pouring. Bores 18 are provided in the matchboard for receiving the present assemblies.

Figure 3:
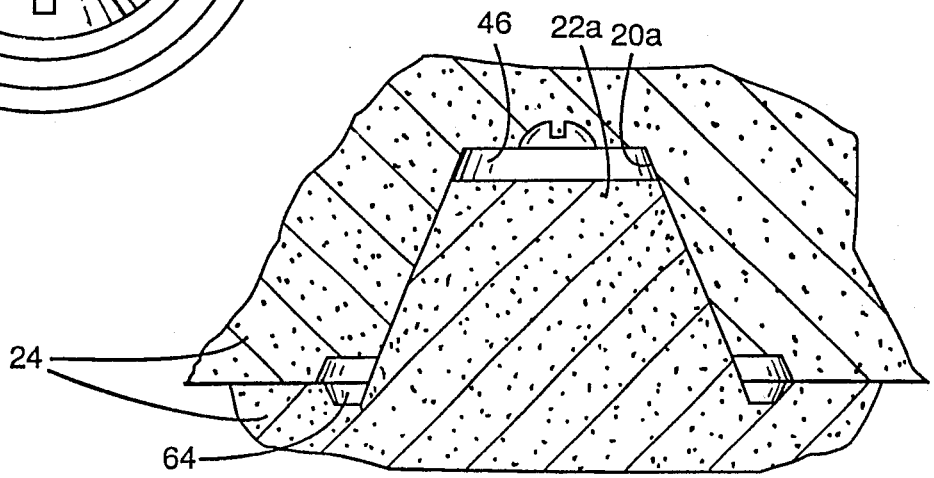
FIG. 3 is a sectional view taken through impression material which has been provided with anti-shift contours by means of the present invention.

The anti-shift structure comprises a male insert 20 and a female insert 22 arranged when mounted at the bore 18 to make recesses 20a and projections 22a, respectively, FIG. 3, in a proper fit in angled portions thereof and spacing in impression material 24 such as sand. These cooperating inserts are associated with the matching faces of the mold and placed selectively with their bores 18 so as to be out of the way of the pattern parts 16. These inserts are also provided in a number generally, at least three, which will provide effective anti-shift functions.

Figure 2:
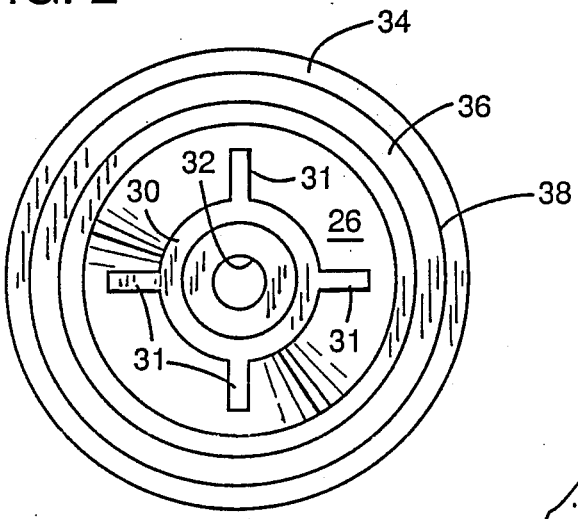
FIG. 2 is a bottom plan view of a first insert.

The insert 20 is frusto-conical in shape and has a flat outer end wall 26 and a defining wall or skirt 28 tapered outwardly from the wall 26. The interior of the insert 20 has a central tubular depending flange 30 open at the bottom. Reinforcing ribs 31, for example, four to eight, also seen in FIG. 2, extend radially between the depending flange 30 and wall 28 and provide sturdy reinforcement of the walls 26 and 28 and the flange 30. End wall 26 has an opening 32 in axial alignment with the tubular flange 30.

The bottom end of defining wall 28 has an outturned rim 34 which extends a short distance beyond the bore 18 for supported engagement of the insert 20 against the matchboard. Axial alignment of the insert 20 with the bore 18 is provided by a depending flange 36 of selected outer diameter for close interfitting engagement at its base with the bore 18. The outer surface 38 of the flange 36 is tapered slightly to a smaller diameter toward its free end to provide mold clearance and also easy insertion of the insert 20 into the bore.

Insert 20 also comprises a hollow frusto-conical member. This insert has an internal tapered surface 40 of selected incline to form a projection 22*a*, FIG. 3, in impression material 24. This projection is arranged to be received in the recess 20*a* made by insert 20. More particularly, the outer surface of wall 28 of insert 20 and the inner surface 40 of insert 22 have identical inclines, for providing a good sand fit as shown in FIG. 3. The angle of incline may vary but an incline of 17 to 22 degrees has been found satisfactory. The over-all internal diameter of wall surface 40 is slightly smaller than the outer diameter of insert 20 to allow for fitted engagement of the impressions 20*a* and 22*a*. Also, the interior dimension or depth 42 of insert 22 is less than the exterior dimension 44 of insert 20 whereby to provide a clearance area 46, FIG. 3, in impressions made by the inserts in the impression material 24. Clearance area 46 also provides a space capable of receiving any impression material that may loosen from the mold. This prevents the possibility of the mold not closing due to the existence of loose impression material between the facing portions of the mold.

The open end of the insert 22 has an outwardly turned rim 48 which projects beyond the bore 18 and provides engaging support of the insert 22 against the matchboard. Insert 22 has an end wall 50 provided with an outwardly projecting circular extension 52 with a selected outer diameter which has telescoping fitted engagement within the tubular flange 30. Extension 52 has a top opening bore 54 arranged to receive a fastener 56 through wall opening 32, this fastener being arranged to engage the extension for pulling the two inserts together and clamping them into engagement with opposite surfaces of the matchboard. Bore 54 may comprise a threaded bore for receiving a screw 56 or may be of a selected unthreaded size to receive a self-tapping screw. Telescoping engagement of the parts 30 and 52 provides precise adjusting alignment of the two inserts through selected thicknesses of matchboards, for exmaple, from three-fourths of an inch to one and one-fourth inch. The relative length of telescoping parts 30 and 52 is preselected such that in a minimum board thickness, such parts will have a clearance 58 at the top and bottom.

The outer surface of insert 22 has a lateral projection 60 adjacent the rim portion 48 for precisely centering this insert in the bore. The outer surface 62 of this projection is tapered slightly to a smaller diameter away from the rim portion 48 to provide easy insertion of the insert 22 in the bore 18.

The two rim portions 34 and 48 together form an annular recess 64 in the impression material for collecting loose sand that may be knocked loose, thus assuring that the matching components will always close when the components are fitted together in the arrangement shown in FIG. 3. Regardless of the position of the cope and drag, namely, regardless of the one that is on the bottom, one or both spaces 46 and 64 collect such loose impression material, whereby the mold will close efficiently even though some impression material has been knocked loose.

According to the invention, an accurate match of mold parts is provided. The insert means herein used are fixedly attached to the matchboard, but removable, and thus there will be no looseness which could possibly cause misalignment, as often is the case where disposable type cores are used. Furthermore, the structure of the present insert allows them to be precisely aligned whereby matching is precise in the impression material. The present invention substantially reduces the costs of the molding operation both in handling time and in cost, as compared with other methods. The inserts are easily installed in a single bore and all that is required is to attach the two members to the matchboard. In addition, the inserts will accommodate matchboards of different thicknesses and at the same time maintain precise alignment and location. Such adjustable thickness and precise alignment is accomplished by the telescoping interfitting engagement of the depending flange 30 and the extension 52. Since the mounting bore for the inserts extends fully through the matchboard, the matching buttons formed can have a deep dimension for providing a good match. The inserts can be made out of plastic that is acid resistant and inexpensive for mass production.

It is to be understood that the form of my invention herein shown and described is to be taken as a preferred example of the same and that various changes in the shape, size and arrangement of parts may be resorted to without departing from the spirit of my invention, or the scope of the subjoined claims.

Having thus described my invention, I claim:

1. An anti-shift assembly for mold matchboards of the type having opposite pattern supporting surfaces, said assembly comprising:

first insert means having a portion thereof arranged to be engaged with one surface of the matchboard and in alignment with a bore in the matchboard, second insert means having a portion thereof arranged to be engaged with the opposite surface of the matchboard at the bore, said first and second insert means having impression forming portions arranged to make recessed and projecting contours respectively in impression material with a close tolerance interfitting engagement when in facing relation to provide anti-shifting connection to opposed portions of the impression material, said first insert means being arranged to project outwardly from the surface of the matchboard against which it is seated and said second insert means being arranged to project into the bore, said first and second insert means having telescopically engaging portions precisely aligning said first and second insert means in their impression forming functions.

2. The anti-shift assembly of claim 1 wherein the telescopically engaging portions of said first and second insert means have relative adjustable engaging movement for use with matchboards of different thicknesses.

3. The anti-shift assembly of claim 1 wherein the telescopically engaging portions of said first and second insert means have relative adjustable engaging movement for use with matchboards of different thickness, and fastener receiving means in said first and second insert means arranged to receive a fastener for holding said insert means together in said adjusted position on opposite surfaces of a matchboard.

4. The anti-shift assembly of claim 1 wherein said impression forming portion of said first and second insert means comprise hollow frusto-conical body members and said telescopically engaging portions comprise cylindrical interfitting portions extending from said respective body members.

5. The anti-shift assembly of claim 1 wherein said first and second insert means include a substantially axially aligned portion arranged to fit in the bore of the matchboard for precisely aligning the inserts in the bore.

6. The anti-shift assembly of claim 1 wherein said impression forming portion of said first and second insert means comprise hollow frusto-conical body members, said body members including a tapered defining wall portion and a substantially axially aligned portion arranged to fit in the bore of the matchboard for locating said inserts in aligned positions in the bore.

7. In combination:

a matchboard having opposite surfaces, a bore in said matchboard opening through said opposite surfaces, first insert means having a portion thereof engaged with one surface of said matchboard and in alignment with said bore, second insert means having a portion thereof engaged with the opposite surface of the matchboard at the bore, said first and second insert means having impression forming portions arranged to make recessed and projecting contours respectively in impression material with a close tolerance interfitting engagement when in facing relation to provide anti-shifting connection to opposed portions of the impression material, said first insert means projecting outwardly from the surface of the matchboard against which it is seated and said second insert means projecting into the bore, said first and second insert means having telescopically engaging portions precisely aligning said first and second insert means in their impression forming functions.

8. The combination of claim 7 wherein the telescopically engaging portions of said first and second insert means have relative adjustable engaging movement for fitting matchboards of different thicknesses.

* * * * *